US005758444A

United States Patent [19]

Ruger et al.

[11] Patent Number: 5,758,444

[45] Date of Patent: Jun. 2, 1998

[54] HAMMER COCKING BOLT LOCKING SYSTEM FOR LEVER OPERATING FIREARM

[75] Inventors: William B. Ruger, Croydon, N.H.; James McGarry, Prescott, Ariz.

[73] Assignee: Sturm, Ruger & Company, Inc., Southport, Conn.

[21] Appl. No.: 582,792

[22] Filed: Jan. 4, 1996

[51] Int. Cl.[6] ..... F41C 7/06

[52] U.S. Cl. ..... 42/16; 42/43; 42/45

[58] Field of Search ..... 42/16, 43, 45, 42/69.03; 89/138, 147, 154

[56] References Cited

U.S. PATENT DOCUMENTS

| | | | |
|---|---|---|---|
| 10,535 | 2/1854 | Smith et al. | 42/21 |
| 19,848 | 4/1858 | Harwood | 74/55 |
| 22,901 | 2/1859 | Temple | 415/161 |
| 502,018 | 7/1893 | Savage | 42/19 |
| 953,292 | 3/1910 | Redfield | 42/21 |
| 1,854,889 | 4/1932 | De Cazen | 42/16 |
| 3,728,810 | 4/1973 | Rohr | 42/69 A |
| 3,803,740 | 4/1974 | Martial | 42/48 |
| 4,028,836 | 6/1977 | Keppeler | 42/69 B |
| 4,132,023 | 1/1979 | Weldle | 42/7 |
| 4,143,636 | 3/1979 | Liepins et al. | 124/40 |
| 4,164,929 | 8/1979 | Liepins et al. | 124/76 |
| 4,648,190 | 3/1987 | Allen | 42/23 |
| 4,879,827 | 11/1989 | Gentry | 42/23 |

OTHER PUBLICATIONS

Sears, R.N., 1980, "The Enduring Savage Model 1899 . . . ", Amer. Rifleman, cover and pp. 24–29.

Triggs, J., "Winchester Model 1873", pp. 304–305 (undated).

*Primary Examiner*—Charles T. Jordan
*Assistant Examiner*—Meena Chelliah
*Attorney, Agent, or Firm*—Pennie & Edmonds LLP

[57] ABSTRACT

A lever action firearm having a receiver, a hammer, a lever pivotal about a fixed point, a bolt and a link which link is pivotal on both the bolt and the lever. The pivotal lever includes first surface means to engage second surface means on the hammer to cause the hammer to be cammed back during unloading. The lever, link and bolt are configured such that when they are in the fire position and are subjected to forces of firing they function as a joint lock to prevent unloading of the bolt and lever. Locking surfaces on the receiver and bolt strengthen the joint lock at the moment of firing.

16 Claims, 9 Drawing Sheets

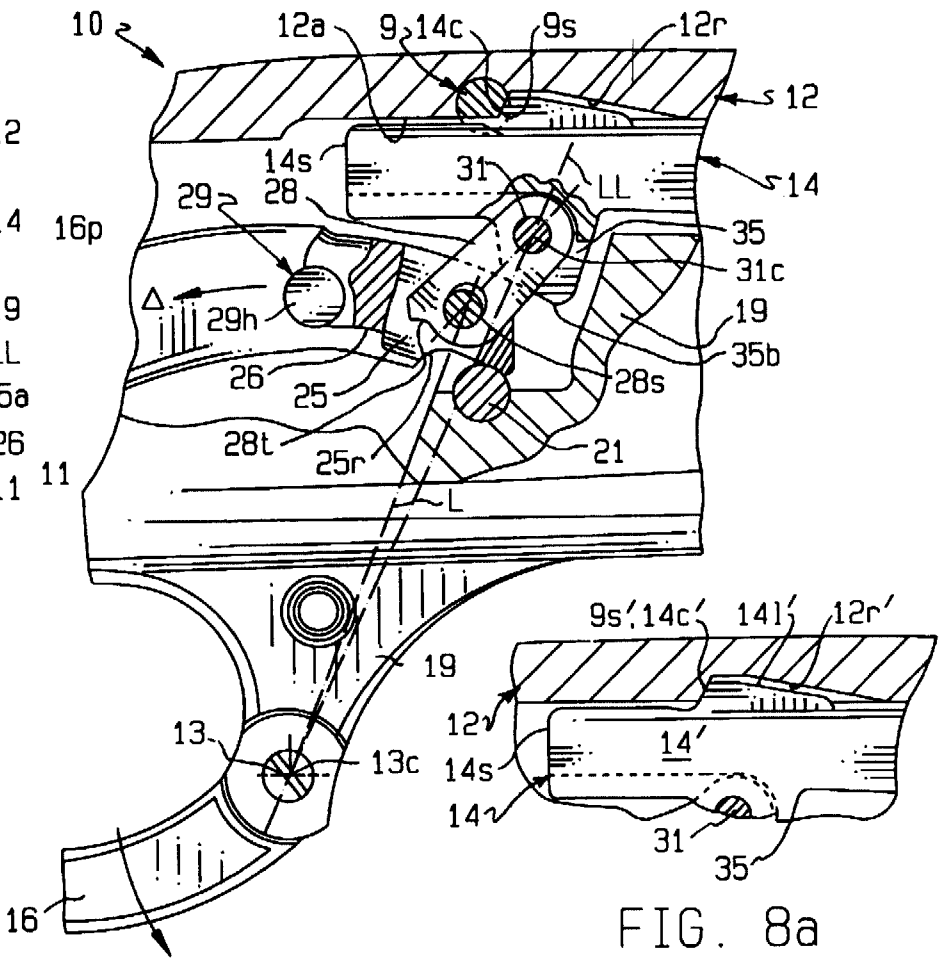
FIG. 9
FIG. 8a
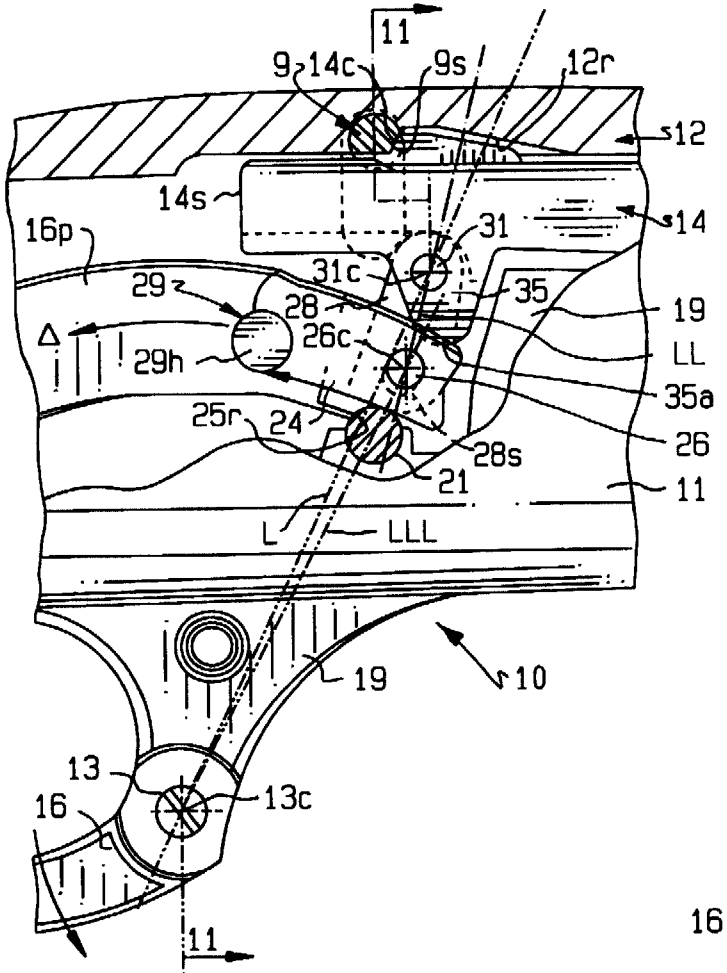
FIG. 8

HAMMER COCKING BOLT LOCKING SYSTEM FOR LEVER OPERATING FIREARM

BACKGROUND OF THE INVENTION

Lever action firearms have included lever locking systems (U.S. Pat. Nos. 10,535 and 502,018). Prior lever action rifles have used linkages to keep the bolt in proper position at the rear of the barrel during the forces generated from firing.

SUMMARY OF THE INVENTION

Broadly, the present invention is an improvement in lever action firearms in which the cocking lever is pivotally connected to the bolt through a relatively short link and in which the cocking lever or side pin extension thereof is engageable with a hammer surface to rotate the hammer back during opening of the lever. To facilitate bolt closing the rear of the bolt and a receiver recess interact to cause the bolt to be swung (upwardly and forwardly during the loading movement of the cocking lever; (2) downwardly and rearwardly as the bolt moves rearwardly immediately after firing; and (3) further downwardly and rearwardly as the cocking lever is manually swung to unload the firearm.

It is a feature of the invention that the cocking lever arm has one or more hammer engaging surfaces to engage the hammer to cause the hammer to be rotated back a sufficient distance during unloading to allow the hammer to move forward a short distance to engage the sear during loading. Such relationship between the cocking lever and hammer allows the hammer to move the lever and its attached bolt forward under certain conditions to assure closing of the bolt before firing.

It is a feature that the bolt engages the receiver along angled sliding surfaces in its locked position which causes, during firing and immediately thereafter, the bolt to move rearwardly and downwardly to increase the force necessary to unlock the bolt thereby resisting unlocking when breech pressures are at their peak during firing. Because of-the shallow angles on this locking projection lug, most of this force is against the receiver with a small amount of force constituting downthrust.

It is a further feature that the shape, configuration and proportion of the lever arm and link are such that immediately following firing when the rear of the bolt is moved downwardly a force is required to cause the lever and link to move from one side of such center line to the other side. During this period the bolt lock operates on a toggle joint or over-center principle.

BRIEF DESCRIPTION OF THE DRAWINGS

FIG. 8 is a partial right side elevational view (without hammer) showing the lever in its forward closed position;

FIG. 8*a* is an alternative embodiment in which the recess is made of a hard material;

FIG. 9 is a partial right side elevational view showing the lever in a partial open position;

DESCRIPTION OF THE PREFERRED EMBODIMENT

Figures 1, 1A:
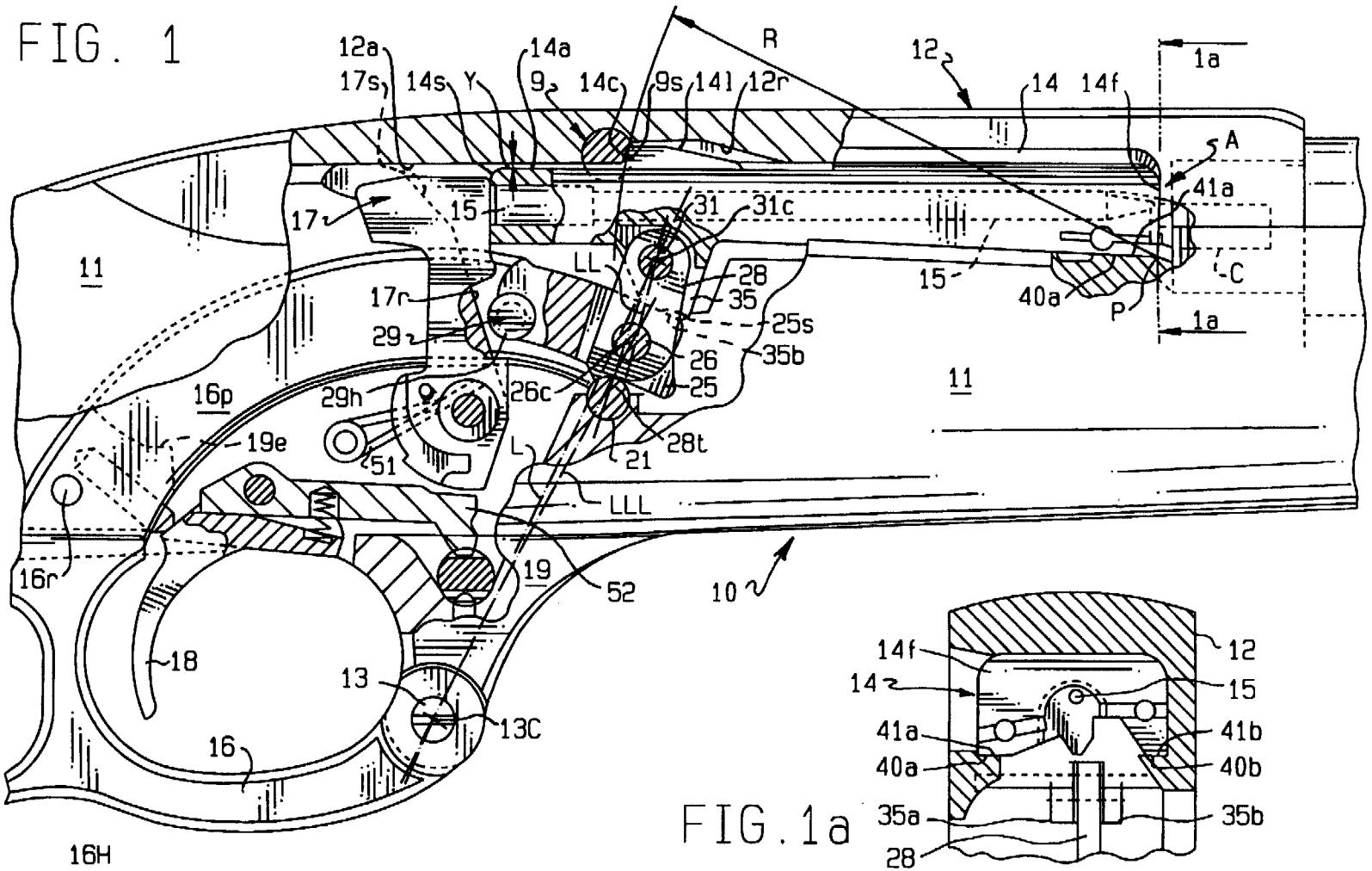
FIG. 1 is a partial right side elevational view of the lever action firearm of the present invention in its lever-closed hammer down position.
FIG. 1*a* is a sectional view taken along line 1*a*—1*a* of FIG. 1.

In FIGS. 1–6, firearm 10, includes stock 11, receiver 12 with its pin section 9, bolt 14, angled bolt locking surface 14*c* on bolt projection lug 141, firing pin 15, cocking and bolt control lever 16, hammer 17, hammer striking surface 17*c* in hammer recess 17*r*, trigger 18 and lever housing 19. Also shown are lever pivot pin 13, cartridge case C, receiver recess 12*r*, receiver cross pin locking shoulder 9*s* and forward and rearward housing cross pins 21 and 22 (see FIG. 5).

Figures 3A, 3B, 3C:
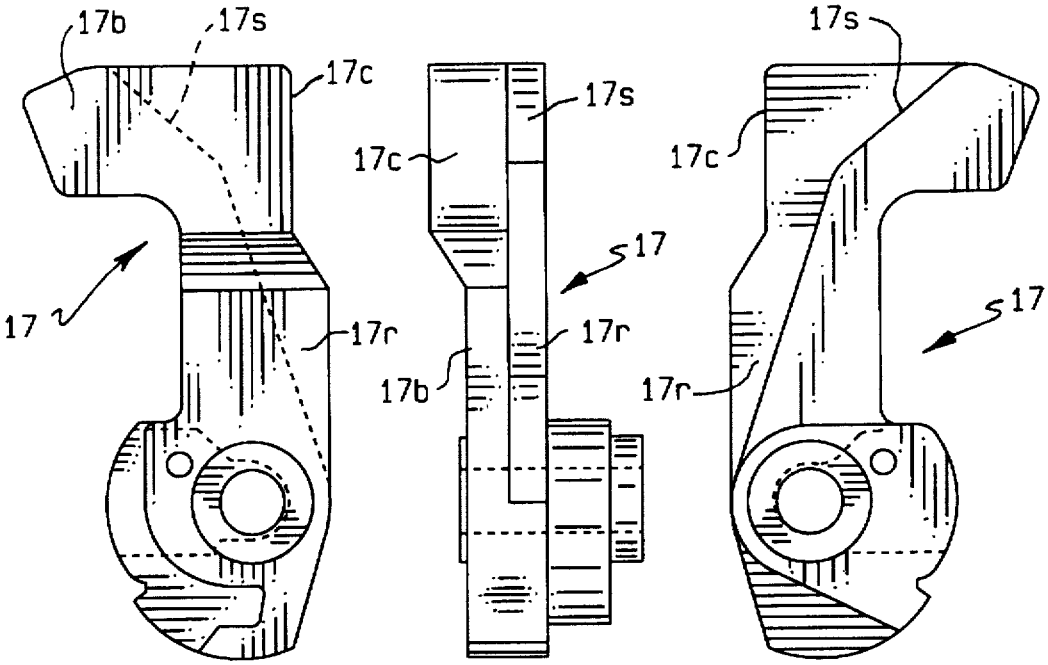
FIG. 3*a* is a right side elevational view of the hammer in its fire position.
FIG. 3*b* is a front elevational view of the hammer in its fire position.
FIG. 3*c* is a left side view of the hammer in its fire position.

Turning to FIG. 3*a*–*c*, hammer 17 includes hammer body 17*b*, hammer recess 17*r* and hammer cam surface 17*s*.

Figure 5:
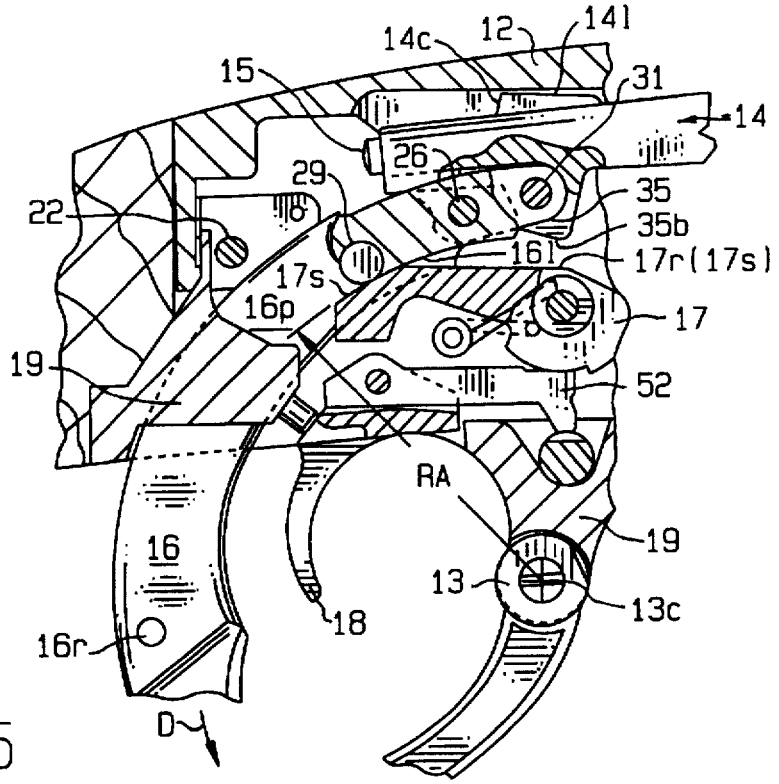
FIG. 5 is a partial right side elevational view of the lever partially opened causing a lever pin to engage the hammer to cock it back.
Figure 6:
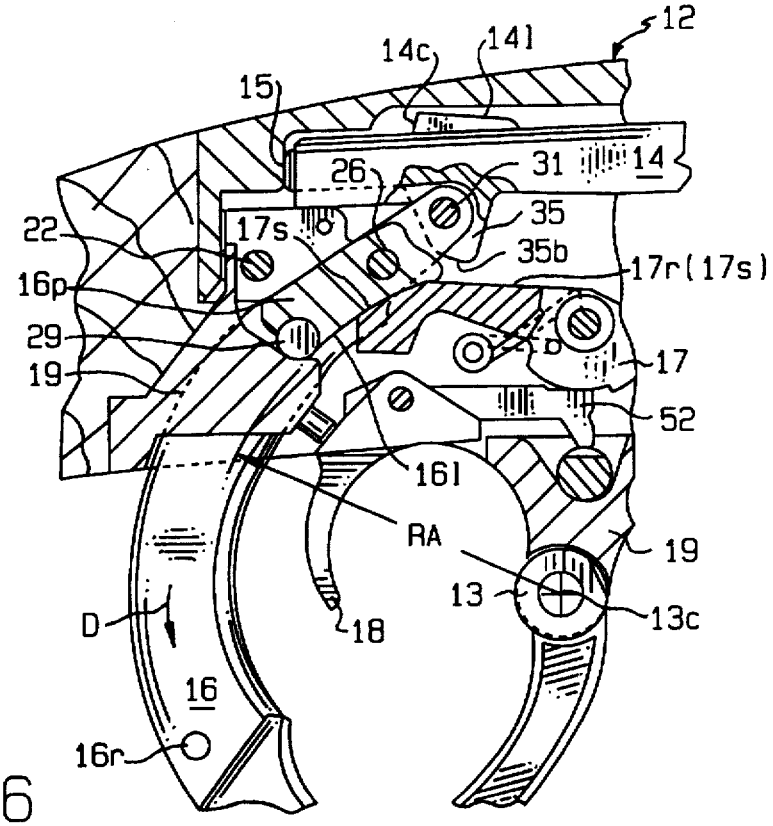
FIG. 6 is a partial right side elevational view with the lever fully open and the hammer is fully cocked back.

Cocking lever 16, pivoted about lever pivot pin 13 on housing 19, includes handle portion 16*h* and cocking arcuate upper arm piece 16*p* with its bifurcated right and left end prongs 24, 25, respectively. Lever 16 is connected to bolt 14 by toggle link 28. Cocking arcuate arm piece 16*p* carries hammer stop pin 29 which includes stem 29*s* and pin head 29*h* (see FIG. 12). Pin head 29*h* projects from the side of lever arcuate piece 16*p* (see FIG. 12). Hammer stop pin 29 functions to engage cam and hammer surface 17*s* in hammer recess 17*r* to rotate hammer 17 rearward to its full rearward position when lever 16 is swung down to unload firearm 10. Initially stop pin 29 engages hammer surface 17*s* to rotate hammer 17. As lever arm 16*p* (and its stop pin 29) travel further back, stop pin 29 leaves contact with hammer surface 17*s* and lower lever surface 16*l* of end prong 24 thereafter engages hammer surface 17*s*. Lower arm surface 16*l* follows an arc inscribed by radius RA about pin 13 (FIGS. 5 and 6). Note that since FIGS. 5 and 6 are right-hand side views, the body portion 17*b* of hammer 17 has been cut away to illustrate the hammer recess 17*r* and its cam surface 17*s*. In this embodiment, hammer 17 is rotated counterclockwise by combined action of pin 29 and lever end prong 24. Cocking lever 16 continues to move downwardly until hammer stop pin 29 engages housing stop surface 19*e*. During the downward movement of cocking lever 16, bolt 14, attached to lever 16 through link 28, is retracted along with the spent (or live) cartridge case.

Figure 7:
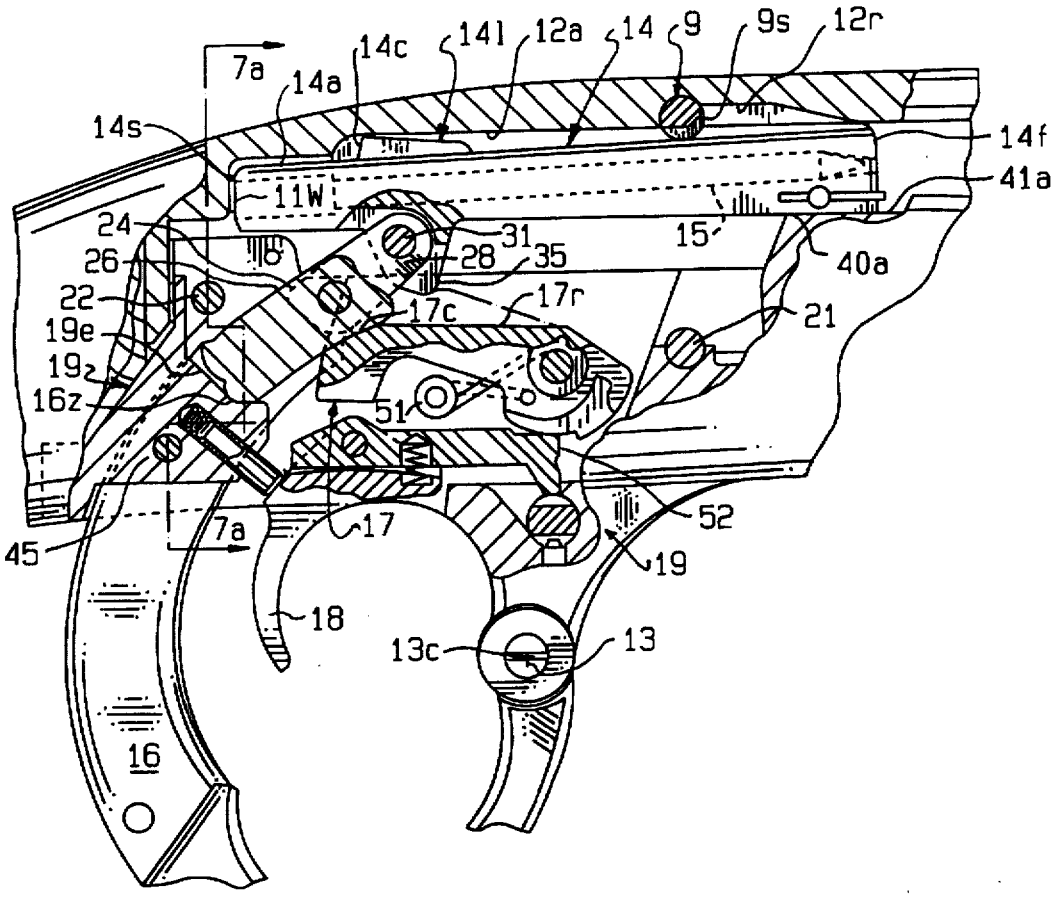
FIG. 7 is an alternative embodiment in which the lever lacks a hammer engaging pin and in which the lever acts directly on the hammer.
Figure 7A:
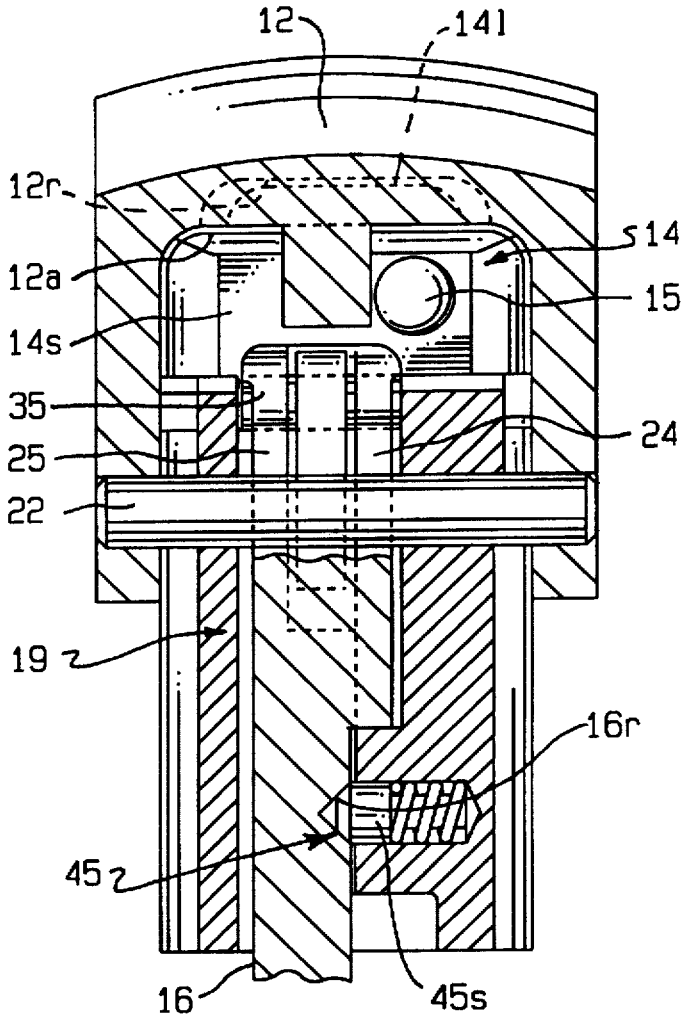
FIG. 7*a* is a sectional view taken along line 7*a*—7*a* of FIG. 7.
Figure 11:
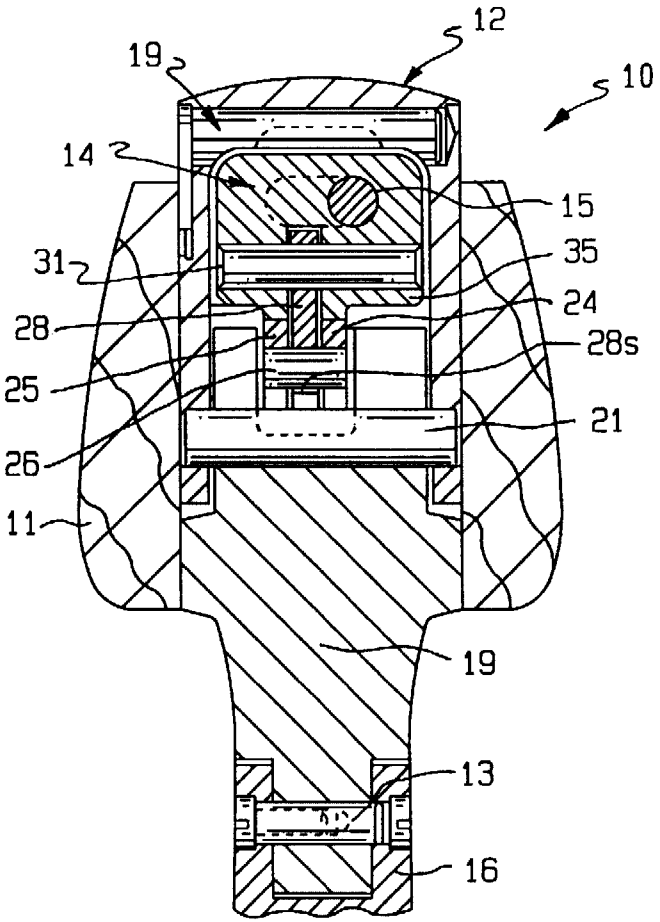
FIG. 11 is a sectional view taken along line 11—11 of FIG. 8.

FIG. 7 shows an alternative embodiment in which no hammer stop pin is employed. Instead, lever arm 16p' including right end prong 25 is made of a harder material permitting end prong 25 to repeatedly engage hammer surface 17s without excessive force to effect hammer rotation in the same manner as pin 29 and the end prong 24 performed in the prior embodiment. Finally, surface 16z of arm 16p engages housing stop 19e. Turning to FIG. 7a, connector pin 22 secures receiver 12 to housing 19. Lever end prong 24 extends downwardly a sufficient distance to engage stop 19e when lever 16 is fully opened with bolt 14 fully retracted.

During loading, cocking lever 16 is swung in the opposite direction upwardly to cause bolt 14 to capture a new cartridge for chambering. When cocking lever 16 reaches its full upward position at the end of its upward travel, bolt 14 is adjacent to and in contact with cartridge case C at point P (see FIG. 1). However, if cocking lever 21 does not fully complete its upward swing during loading but instead stops short of casing C in an intermediate position, leaving bolt 14 spaced from cartridge C, and when trigger 18 is thereafter pulled, the falling hammer 17 and its surface 17s engages hammer stop pin 29 and under urging of hammer spring 51 moves lever 16 (and connected bolt 14) forward against cartridge C. Such an intermediate position cannot be reached until hammer stop pin 29 has moved forward of hammer surface 17s. Movement from an intermediate position to a fire position is accomplished by hammer surface 17s engaging pin head 29h projecting from the side of lever 16. Pin 29 and its head 29h are located on arcuate arm prong 24 in such a position hat as hammer 17 falls under the urging of spring 51 it causes lever 16 to move upwardly and forwardly until bolt 14 is locked against cartridge case C at point P. This action of the hammer 17 on head 29h of stop pin 29 assures that bolt 14 is in its closed proper ready-to-fire position prior to actual firing of firearm 10. Hammer 17 cannot strike firing pin 15 (bolt 14) until lever 16 is a few thousandths of an inch from being fully closed (i.e.,0.040–0.50 inches).

Thus, lever 16 has a fully open position (FIG. 2) with pin 29 against housing stop surface 19e; a fully closed position (FIG. 1) in which bolt 14 is in full contact at point P against cartridge case C and lever 16 can also have a temporary less-than-fully-closed position in which bolt 14 is touching cartridge case C or spaced a short distance from case C. When bolt 14 is touching case C, but in its unlocked (down) position, or partial down position, striking of pin 29 by hammer 17 will then close the lever 16 fully locking bolt 14. In this position, lever 16 with its projecting pin head 29h (hammer 17) in its cocked position) is positioned forward of hammer surface 17s. Pin head 29h is engaged by hammer surface 17s during hammer 17' travel after being released by sear 52 thus moving lever 16 (and bolt 14) forward to assure bolt 14 is closed and locked prior to firing. In the fully open position of lever 16, the rear surface 14s of bolt 14 is slightly spaced from rear receiver wall 11w (FIG. 7) of receiver 12. This clearance, assured by hammer stop pin 29 contacting seat 19e, prevents strain on the forward ends 24, 25 of forward lever portion 16p of lever 16.

Figure 4:
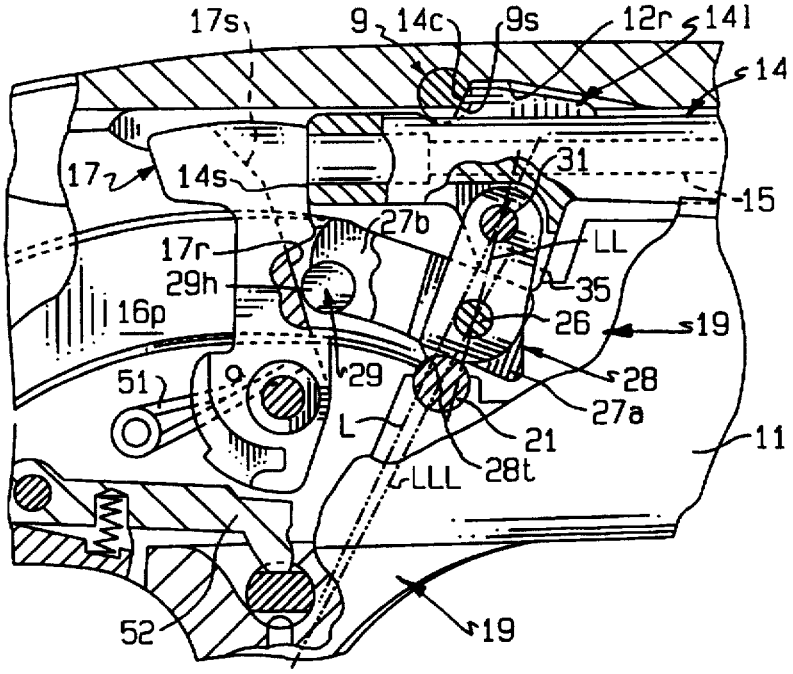
FIG. 4 is a partial right side elevational view showing a portion of FIG. 1.
Figure 10:
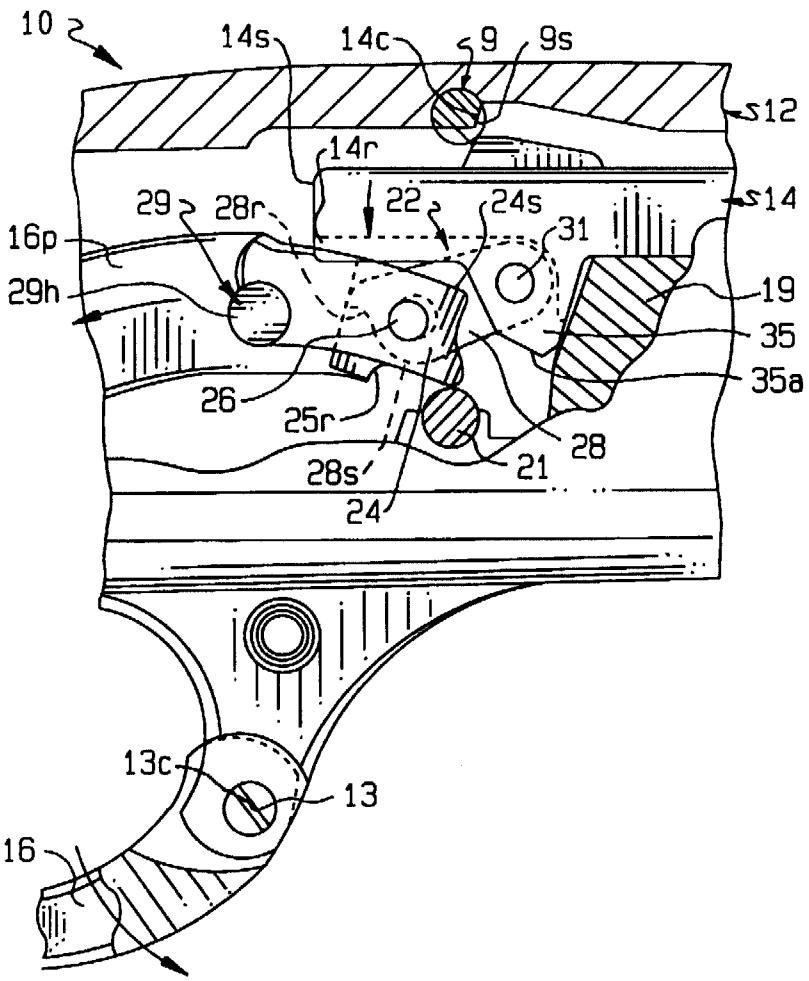
FIG. 10 is a partial right side elevational view showing the lever further opened and the bolt rotated down.
Figure 12:
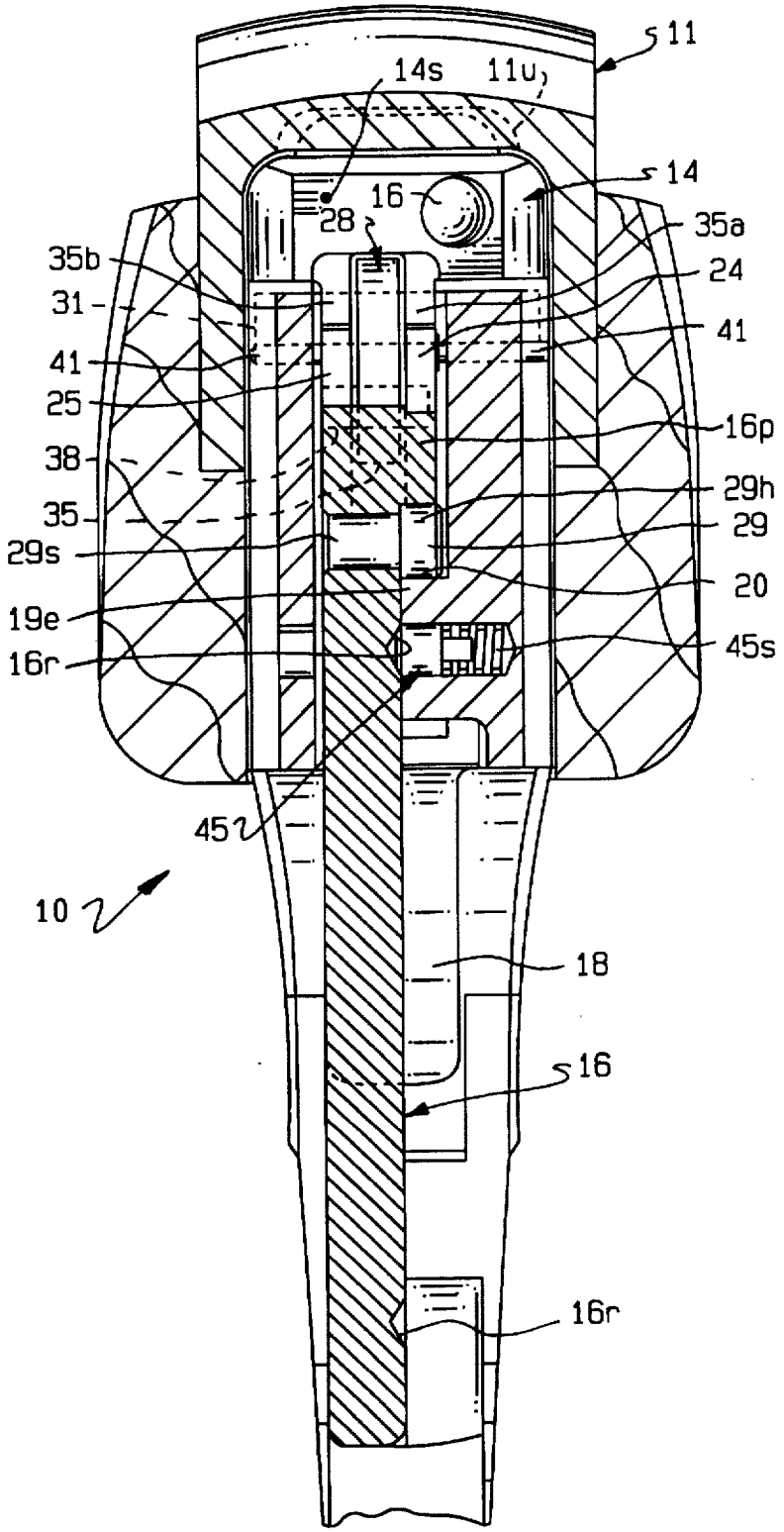
FIG. 12 is a sectional view taken along line 12—12 of FIG. 2.

Turning to FIGS. 8, 9 and 10, the system for resisting the unlocking of bolt 14 upon firing includes lever arm portion 16p with its forward end bifurcated right and left arm prongs 24, 25, respectively; the lever arm end pin 26; link 28 sandwiched between lever arm prongs 24, 25; and bolt cross pin 31. Bolt cross pin 31 is located in bolt lower portion 35. Elongated link slot 28s rides over arm pin 26. Movement toward a bolt lock position is attained when lever arm prongs 24, 25 are moved forward until the center 26c of arm end pin 26 is forward of line L as shown in FIGS. 1, 4 and 8. Line L is the center line between center 31c of bolt cross pin 31 and the center 13c of stationary housing pin 13. During locking of the system, lever arm portion 16p with its end prongs 24, 25 and connected link 28 are swung and oriented to positions where center line LL and line L become superimposed upon one another. Line LL is the line between pin center 31c and pin center 26c. During such movement toward locking, lever 16 continues its forward and upward movement until it reaches the fully locked position (FIGS. 1, 4 and 8). In the lock position, tail 28t on link 28 engages pin 21 to limit arm portion 16p movement and at this point detent 45 snaps into position (FIG. 12). As bolt 14 is moved to the lock position, bolt 14 is urged upwardly causing bolt upper angled lock surface 14c to engage complementary receiver lock shoulder 9s which, due to such complementary angles of such surfaces, urges bolt 14 toward and against cartridge case C at surface area A. Bolt 14 travels forward until it meets case C at area A or when the chamber is empty it meets area A. When bolt 14 cannot move forward any further, and since lever portion 16p is still rotating forward, link 28 rotates around bolt pin 31 and lever pin 26. Further, since center 26c is a set distance from pin center 13c, rotation of link 28 causes pin 31 to rise and bolt 14 to pivot about point P through radius R resulting in its rearward end rising into its locking recess 12r and against surface 9s. There is clearance between surface A and bolt face 14f to permit such bolt 14 rotation about pivot point P FIG. 1).

Turning to FIGS. 1 and 1a, bolt guide rails 40a, 40b ride in receiver grooves 41a, 41b and provide pivot point P, about which bolt 14 pivots during its locking movements. In the fully locked position, bolt lower portion surfaces 35a, 35b engage upper prong surfaces 24s, 25s (see FIGS. 1, 8 and 10) which engagement assists in holding the system in its locked positions.

Figure 2:
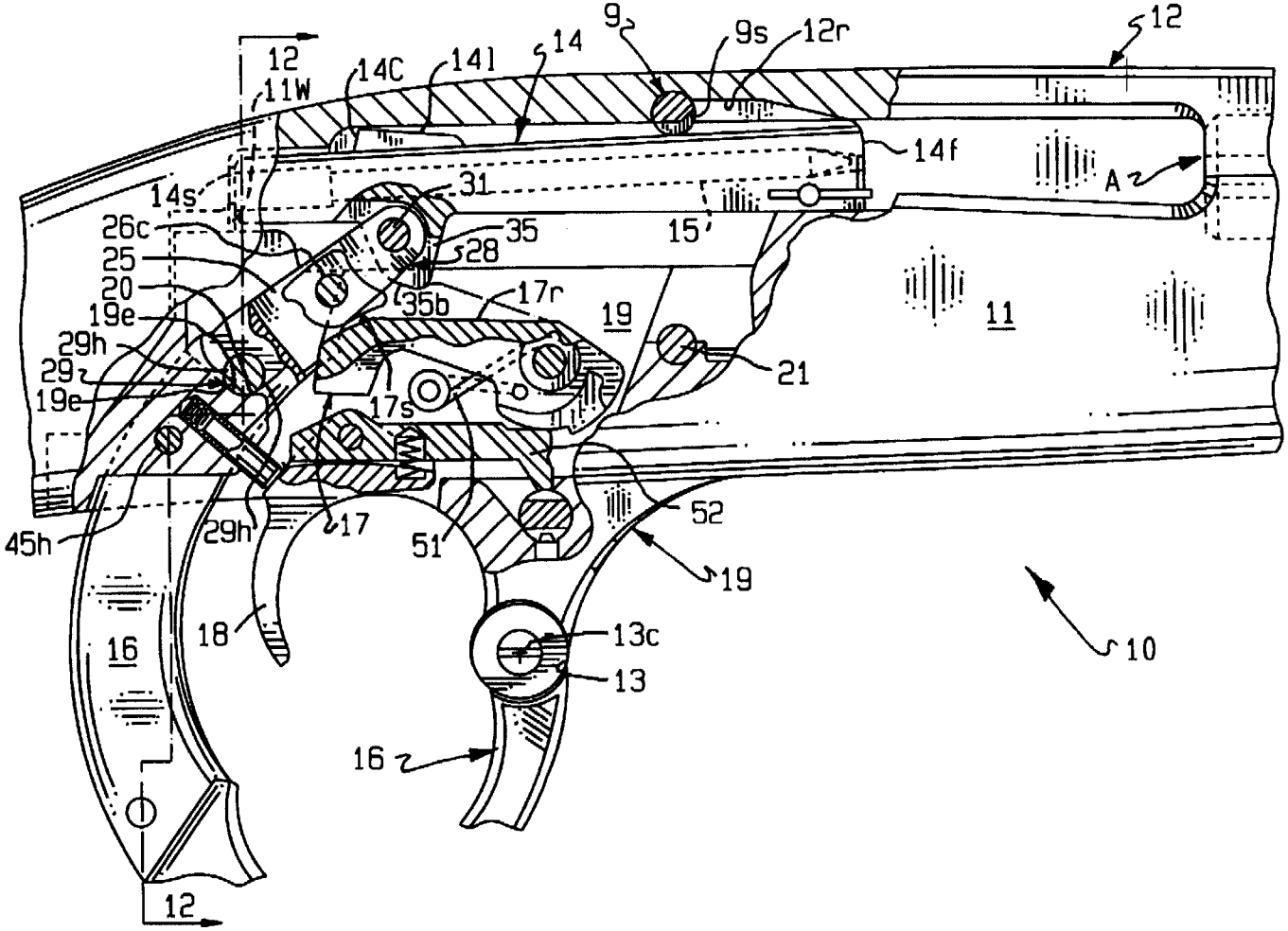
FIG. 2 is a view similar to FIG. 1 in which the firearm lever is in its fully open position.

Upon firing, forces are created (including those from the expanding cartridge C against bolt face 14f) which forces cause bolt 14 to resist forward movement, remain stationary or when the forces created by expanding gases are great enough bolt 14 will move slightly rearwardly and downwardly as bolt lock surface 14c and receiver lock surface 9s move relatively to one another. Such surface-to-surface relative motion, when it occurs, is reflected in the increased clearance between receiver rearward surface 12a and upper rearward bolt surface 14a which clearance Y varies as bolt 14 is locked and unlocked (FIG. 1). Clearance Y is smallest when pin centers 13c, 26c and 31c are all in a straight line (lines LL, L and LLL all superimposed). This alignment is the start of the over center-lock position. Once arm 16p including its prongs 24, 25 passes such pin center 31c, 26c and 31c alignment, arm 16p moves clockwise until fully locked (FIG. 2). Firing at any time during such movement from such pin center alignment to and including the fully locked position (FIG. 1) will result in movement of bolt 14 as described above, causing bolt pin 31 to move downwardly creating a toggle (over-center) arrangement which toggle lock is strengthened by such bolt pin movement. Firing forces acting on bolt 14 increase the strength of the bolt/lever lock. In this toggle (over-center) situation, an unlock force of substantial magnitude would be required to move cocking lever 16 (and its pin 26) rearwardly toward line L and beyond it (over-center).

At the moment of firing, it is important that bolt 14 remain securely closed in such fully seated lock position to protect the cartridge case C from rupturing due to the high pressure gases produced. When cartridge C is fired it produces a back thrust against the bolt face 14f which is transmitted from bolt surface 14*c* to recess surface 12*s*. Most of the force is transferred to receiver 12, but since 14*c* and 12*s* are angled to allow surface 14*c* to drop and unlock, a fractional down force is transmitted to triangles L, LL and LLL through centers 13*c*, 31*c* and 21*c*, as well as surfaces 24*s*, 25*s*, 35*a*, 35*b* (FIGS. 1, 4 and 8), all to increase the strength of the lock system as explained above.

To unlock the system after firing is complete, cocking lever 16, including its arm portion 16*p*, are moved in direction (D) (see FIGS. 9 and 10) with little or no force except that to overcome detent 45 (see FIGS. 7*a* and 12), the force to cock back hammer 17 and any friction in the system. As lever 16 is moved rearwardly, prongs enter bolt recess 14*r* to provide clearance (FIG. 10). The elongation of the link slot 28*s* allows lever portion 16*p* to rotate in direction D without pulling down bolt 14 until the lever prong surfaces 24*s*, 25*s* have cleared the bolt prong surfaces 35*a*, 35*b*.

FIG. 8*a* shows an alternative embodiment in which receiver 12 is made of steel obviating the need for a pin 9*p*. Recess surface 9*s*' engages bolt surface 14*c*'.

Finally, with reference to FIG. 12, in its locked position, cocking lever 16*p* is further secured by a spring loaded detent 45 which is mounted in housing 19 with a detent nose 45*n* engaged in a recess 16*r* of lever 16. Spring 45*s* urges nose 45*n* into recess 16*r*.

Receiver 12, lever 16 and lever housing 19 are preferably made of an aluminum alloy or other light material with pins 9, 29; and link 28, bolt 14 and pin 21 being made of steel or other hard material for strength and to reduce wear.

We claim:

1. In a lever action firearm having a frame, a cartridge chamber, a receiver, a bolt with a forward and rear end, a hammer, a hammer pivot, a cocking lever and a cross pin in the frame about which the cocking lever pivots to unload and load comprising a) a configured hammer surface having a bolt striking surface and a cocking surface spaced from the bolt striking surface;

b) the cocking lever movable from an unload Position to a load position which lever includes a hammer engageable portion and in so moving passes over and forward of the hammer so that the hammer is capable of engagement with such lever portion as the hammer falls; and c) hammer engaging means on the cocking lever positioned such that the hammer engaging means engages the hammer cocking surface to rotate the hammer away from the cartridge chamber when the lever is cocked to unload.

2. The lever action firearm of claim 1 in which the hammer engaging means is a pin surface mounted on the cocking lever.

3. The lever action firearm of claim 1 in which the hammer engaging means on the lever is engaged by the hammer surface during forward movement of the hammer to fire when the lever is not fully forward.

4. In a lever action firearm having a receiver, a bolt, a pivotal hammer, a cocking lever, and a cross pin about which the cocking lever pivots comprising a) hammer surface means;

b) hammer engaging means positioned on the cocking lever such that cocking of the lever about its pivot rotates the hammer back;

c) a lock surface on the receiver and a complementary lock surface on the bolt;

d) a pin on the bolt and a pin on the cocking lever;

e) a link with one end mounted on the bolt pin and the other end mounted on the lever pin;

f) a center line between the bolt pin and the lever cross pivot pin; and g) the link and lever being so configured such that the receiver lock surface and bolt lock surface engage under forces of firing to cause movement relative to one another to resist movement of the link and lever through such centerline from a position forward of such center line to a position rearward of such center line.

5. The firearm of claim 4 in which at the time of firing and for a short time thereafter the bolt lock surface and complementary receiver lock surface resist movement relative to one another as the forward end of the bolt is engaged by the cartridge which prevents the bolt pin on the bolt to move.

6. The firearm of claim 4 in which upon completion of firing, small forces to overcome (a) a detent, (b) hammer cocking and (c) friction are applied to the cocking lever to unlock the lever and its connected bolt.

7. The firearm of claim 4 in which the receiver is made of a first material and in which the receiver has a receiver cam surface which cam surface is made of a second material which is harder than the first material.

8. The firearm of claim 6 in which the receiver is fabricated of a first material and has inserted therein a cross pin of a second material harder than the first material.

9. The firearm of claim 4 in which the firearm has in addition a stock and in which the receiver and the stock are connected by pin means.

10. The firearm of claim 4 in which the link has in addition an elongated slot to receive the cocking lever pin.

11. The firearm of claim 4 having in addition an elongated slot in the link to receive the cocking lever pin.

12. In a lever action firearm having a frame, a cartridge chamber, a receiver, a bolt, a pivotal hammer, a cocking lever and a cross pin in the frame about which the cocking lever pivots to unload and load comprising a) a configured hammer surface; and b) hammer engaging means including a forward arcuate portion on the cocking lever positioned such that the hammer engaging means engages the hammer surface to rotate the hammer away from the cartridge chamber when the lever is cocked to unload.

13. In a lever action firearm having a frame, a cartridge chamber, a receiver, a bolt, a pivotal hammer, a cocking lever and a cross pin in the frame about which the cocking lever pivots to unload and load comprising a) a configured hammer surface;

b) hammer engaging means on the cocking lever positioned such that the hammer engaging means engages the hammer surface to rotate the hammer away from the cartridge chamber when the lever is cocked to unload; and c) link means between the lever and the bolt to permit the bolt to be moved back and down by the lever and to be moved forward and up by the lever.

14. The lever action firearm of claim 13 having in addition a lock surface on the receiver and a complementary lock surface on the bolt which surfaces engage shortly after firing as the forward end of the bolt is in engagement with the cartridge.

15. The lever action firearm of claim 4 having in addition first guide means on the receiver and second guide means on the bolt.

16. The lever action firearm of claim 15 in which the first guide means and second guide means interact to provide a pivot about which the bolt pivots when locked.

* * * * *